US005652986A

United States Patent [19]

Wells

[11] Patent Number: 5,652,986

[45] Date of Patent: Aug. 5, 1997

[54] INNER SPRING MATTRESS HAVING NESTABLE CONICAL SPRINGS

[75] Inventor: Thomas J. Wells, Carthage, Mo.

[73] Assignee: L&P Property Management Company, Chicago, Ill.

[21] Appl. No.: 539,480

[22] Filed: Oct. 5, 1995

[51] Int. Cl.[6] ..... F16F 3/00

[52] U.S. Cl. ..... 5/716; 5/655.7; 5/654.1

[58] Field of Search ..... 5/267, 269, 272, 5/271, 274, 276, 255, 256, 248, 475

[56] References Cited

U.S. PATENT DOCUMENTS

| | | | |
|---|---|---|---|
| 136,473 | 3/1873 | Ward | 5/256 |
| 197,405 | 11/1877 | Read | 5/256 |
| 727,265 | 5/1903 | Beall | 5/272 |
| 3,953,903 | 5/1976 | Lawerence et al. | 5/267 |
| 4,112,528 | 9/1978 | Higgins | 5/248 |
| 4,639,957 | 2/1987 | Wells et al. . | |
| 5,052,064 | 10/1991 | Hagemeister et al. . | |
| 5,104,099 | 4/1992 | Long | 5/256 |
| 5,176,367 | 1/1993 | Rodgers et al. | 5/255 |
| 5,178,372 | 1/1993 | Rodgers et al. . | |
| 5,246,210 | 9/1993 | Dabney et al. . | |
| 5,361,434 | 11/1994 | Hagemerster et al. | 5/255 |
| 5,395,097 | 3/1995 | Dabney et al. . | |
| 5,401,007 | 3/1995 | Dabney et al. | 5/255 |

*Primary Examiner*—Rodney M. Lindsey
*Assistant Examiner*—Fredrick Conley
*Attorney, Agent, or Firm*—Wood, Herron and Evans, L.L.P.

[57] ABSTRACT

An inner spring core comprises a nestably stackable first spring unit and a second generally planar stackable grid unit. The nestably stackable first spring unit comprises a first generally planar platform and a plurality of generally conical spring elements extending in one direction from the first generally planar platform. Each of the generally conical spring elements is in a preferred embodiment a double twist coil spring which has a bottom planar portion in the plane of the first generally planar platform, and two spring arms extending upwardly from the bottom planar portion terminating in a distal end portion. The second generally planar stackable grid unit is secured to the distal end portions of the generally conical nestable spring elements by a plurality of connectors located generally in the plane of the second stackable grid unit.

20 Claims, 4 Drawing Sheets

INNER SPRING MATTRESS HAVING NESTABLE CONICAL SPRINGS

FIELD OF THE INVENTION

This invention relates to an inner spring mattress and a method of manufacturing the same; more particularly to an inner spring consisting of one nestably stackable spring unit and a flat stackable grid unit, the two units being lockingly connectable to form a completed inner spring.

DESCRIPTION OF THE PRIOR ART

Mattress inner spring units are typically made up of rows and columns of coil springs, each coil spring having a top and bottom planar portion. Adjacent rows of coil springs usually are connected with helical lacing wire at their top and bottom planar portions. The top and bottom planar portions of the outer most coil springs usually are attached to a rectangular border wire with either clips or lacing wire. Assembling a complete inner spring core in such fashion is costly and requires expensive machinery.

Once such an inner spring core has been assembled it is typically shipped to a manufacturer's upholstery plant for insertion of a pad over the top planar portion of the coil springs and is covered with upholstery, Inner spring cores are typically shipped to the manufacturer using a technique called bailing. A bail is several compressed fully-assembled mattress inner spring cores stacked one on top of another; the stack is covered at the top and bottom with a rigid piece of plywood or other suitable material for protection and support. The bail is tied together with two or more heavy encompassing wires to prevent lateral movement of the individual mattress inner spring cores. The heavy encompassing wires are bound tightly in an effort to compress the individual inner spring cores.

Upon arrival at the manufacturing facility the heavy encompassing wire must be removed in order to remove the individual inner spring cores for further processing. Because the heavy encompassing wires are under high tension, disassembling a bail of compressed inner spring cores is dangerous, expensive and slow.

In addition to the potential danger and expense associated with bailing together a group of individual spring cores for shipping, another problem is that the spring cores are bulky and space consuming. Absent the compression caused by the taught encompassing wires, each individual inner spring core takes up as much room as it would fully assembled at rest. When the bales are shipped to a manufacturer relatively few bails of fully assembled inner spring cores are able to fit inside a truck or other mode of transportation. Therefore, using bailing as a means of packing inner spring cores for shipment is inefficient and costly.

One solution which has been suggested to solve this spacing problem has been to ship the inner spring cores in individual half units which are stacked one upon the other or nested rather than to ship the inner spring cores preassembled. Upon arrival at their destination the stacked units are unstacked and snap-fit together to form fully assembled spring cores. U.S. Pat. No. 5,401,007 and U.S. Pat. No. 5,395,097 both issued to Dabney et al. disclose a wire spring assembly made of two nestably stackably half units which are snap-fit together to form a whole fully assembled inner spring core. Each of the assemblies disclosed in these two patents is made of two similar half units, each half unit of which has very complex spring elements extending from a generally planar deck. These complex spring elements, although nestable, are costly to manufacture and subject to being bent during shipping.

U.S. Pat. No. 4,639,957 issued to Wells et al. and assigned to the assignee of the present invention discloses a double twist coil spring and method for manufacturing the same. The same double twist coil spring is utilized in the invention which is the subject of this application. The disclosure of U.S. Pat. No. 4,639,957 is hereby fully incorporated by reference into this application. This spring is knotless and has two spring arms which give it balance and firmness on either side of the spring. The two spring arms terminate in two co-planar free ends which provide a flexible yet sturdy means to connect adjacent springs. The double arm spring is subject to large manufacturing tolerances which lowers the cost of manufacturing.

It has been an objective of the present invention to utilize a double twist coil spring in a stackable unit, which unit may be nestably stacked on top of a like unit, thus lowering the space required to ship several units.

It has been another objective of the present invention to provide a method of manufacturing an inner spring core in which a nestably stackable first spring unit having a plurality of double twist coil springs may be attached to a generally planar second unit or grid.

It has been another objective of the present invention to lower the cost and ease of shipping and manufacturing spring core units without bailing or compressing preassembled inner spring cores.

SUMMARY OF THE INVENTION

The inner spring core of the present invention comprises a nestable stackable first spring unit, a second relatively planar stackable grid unit and a plurality of connectors located in the plane of the second relatively planar grid unit such that the two units may be relatively easily and inexpensively interconnected, preferably without the use of separate connectors. The nestably stackable first spring unit comprises a first generally planar platform from which a plurality of generally conical nestable spring elements extend in one direction, each of the spring elements terminating in a generally planar distal end portion. The second stackable grid unit comprises a second generally planar platform which may have a plurality of connectors located in the plane of the second platform lockingly engagable with the planar distal end portions of the spring elements of the nestably stackable first spring unit. A fully assembled inner spring core is formed upon the locking engagement of the distal end portions of the spring elements of the nestably stackable first spring unit to the second stackable grid unit.

During assembly a stack of the nestably stackable first spring units is placed on a horizontal surface with their generally conical nestable spring elements extending upwardly and their generally planar platforms therebelow. The generally planar platform of the bottommost nestably stackable first spring unit rests on a horizontal surface. A second generally planar stackable grid unit is placed on top of the planar distal end portions of the spring elements of the uppermost nestably stackable first spring unit, pushed down and interlocked with the nestably stackable first spring unit, thereby creating an assembled inner spring core with a minimum of effort and cost.

BRIEF DESCRIPTION OF THE DRAWINGS

FIGS. 3A–C illustrate the method of assembling the inner spring core of the present invention in single line schematic elevational views in which:

FIG. 3A is a single line schematic elevational view of a second stackable grid unit being lowered onto a stack of nestably stackable first spring units.

FIG. 3B is a single line schematic elevational view of a second stackable grid unit resting on top of the uppermost of the stacked nestably stackable first spring units and twisted so as to lockingly engage the connectors of the second stackable grid unit with the planar distal end portions of the spring elements of the uppermost nestably stackable first spring unit.

FIG. 3C is a single line schematic elevational view of a fully assembled inner spring core being pulled up and away, the uppermost nestably stackable first spring unit separating from the stack of nestably stackable first spring units therebelow.

FIGS. 4A and B are perspective views of a method of lockingly engaging one of the snap-fit connectors of a second stackable grid unit to the planar distal end portion of one of the spring elements of a nestably stackable first spring unit in which:

FIG. 4A is a perspective view of a snap-fit connector of a second stackable grid unit being lowered onto a planar distal end portion of a spring element of a nestably stackable first spring unit and the spring element being rotated so the cross bar of the spring element fits between a set of connectors on a second stackable grid unit.

DESCRIPTION OF THE PREFERRED EMBODIMENTS

Figure 1:
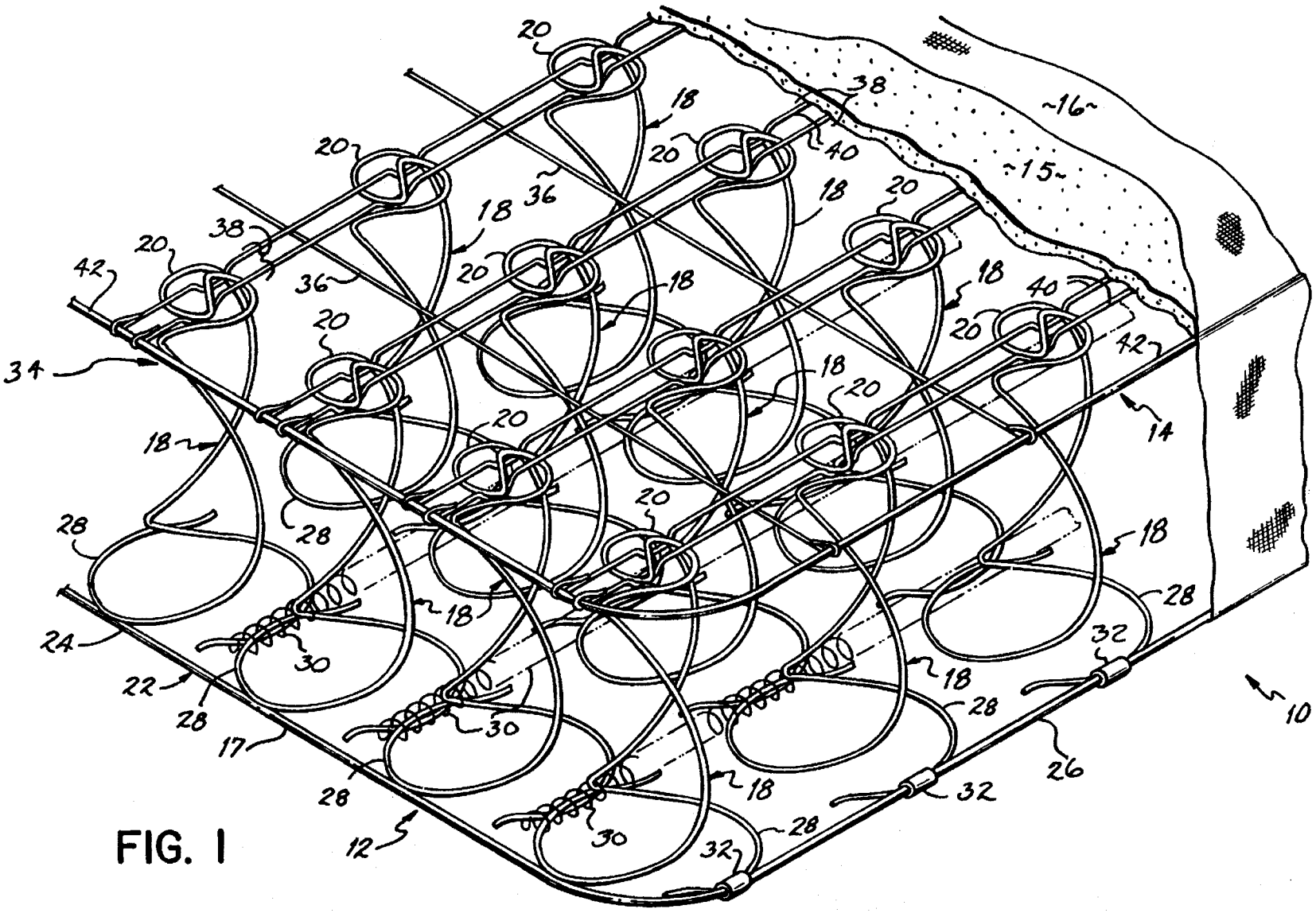
FIG. 1 is a perspective view of a fully assembled inner spring core of the present invention.

Referring to the drawings and particularly to FIG. 1 there is illustrated a fully assembled inner spring core 10 comprising a nestably stackably first spring unit 12 and a second stackable grid unit 14 lockingly engaged with one another. The fully assembled inner spring core 10 has a pad 15 resting on the second stackable grid unit 14 and an upholstered fabric covering 16 encasing the fully assembled inner spring core 10 and the pad 15.

The nestably stackable first spring unit 12 has a first generally planar platform 17 from which extend in one direction a plurality of generally conical nestable spring elements 18. Each of the spring elements 18 terminates in a planar distal end portion 20 which lockingly engages with the second stackable grid unit 14 in a manner hereinafter described.

The generally planar platform 17 of the nestably stackable first spring unit 12 comprises a generally rectangular border wire 22 having two side border wires 24 and two end border wires 26. Also included within the generally planar platform 17 is the bottom planar portion 28 of each of the spring elements 18. These bottom planar portions 28 of the spring elements 18 are arranged in rows and columns. A plurality of helical spring wires 30 connect adjacent rows of bottom planar portions 28 of adjacent spring elements 18. The helical lacing wires 30 are parallel to one another and do not connect with and are not associated with the border wire 22. The helical lacing wires 30 extend from a point just inside one side border wire 24 across the generally planar platform 17 to a point just inside the other side border wire 24. The planar bottom portions 28 of the spring elements 18 adjacent the border wire 22 are connected to the border wire 22 with conventional clips 32 or other suitable means.

A second stackable grid unit 14 comprises a substantially planar wire grid platform 34 which consists of a plurality of straight longitudinal wires 36 and a plurality of pairs 38 of transverse wires 40. The pairs 38 of transverse wires 40 are perpendicular and connected at their points of intersection with the longitudinal wires 36 of the wire grid platform 34. The wire grid platform 34 is fixedly attached to the border wire 42 in any conventional manner such as wrapping the ends of the longitudinal wires 36 and transverse wires 40 to the border wire 42 of the second stackable grid unit 14.

Each of the transverse wires 40 of the second stackable grid unit 14 has a series of evenly spaced connector crimps 44. Each transverse wire 40 has one connector crimp 44 for each spring element 18 to be lockingly engaged thereto. The connector crimps 44 on one transverse wire 40 of a pair 38 of transverse wires are horizontally offset relative to the connector crimps 44 on the other transverse wire 40 of the pair 38 of transverse wires. Such an offset facilitates reception of the planar distal end portion 20 of a spring element 18 of the nestably stackable first spring unit 12. A set of offset connector crimps 44, one connector crimp on each transverse wire 40 of a pair 38 of transverse wires 40 form one snap-fit connector 46 in the plane of the wire grid platform 34. Each snap-fit connector 46 receives the planar distal end portion 20 of one spring element 18 of a nestably stackable first spring unit 12.

Figure 3A:
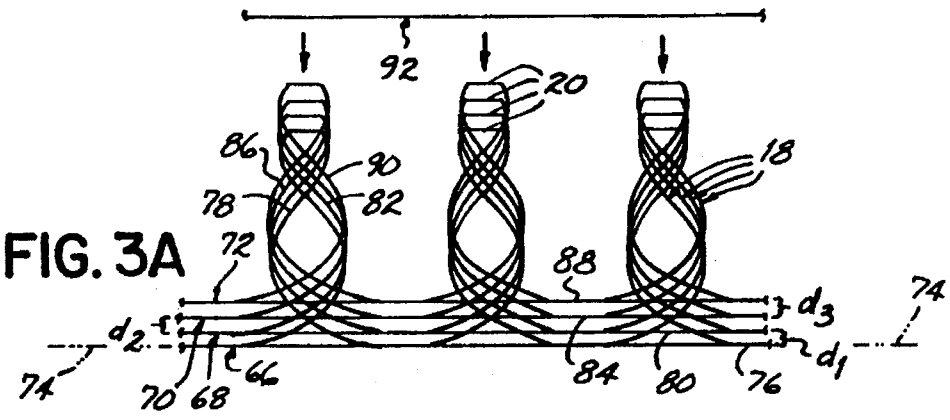
Figure 3B:
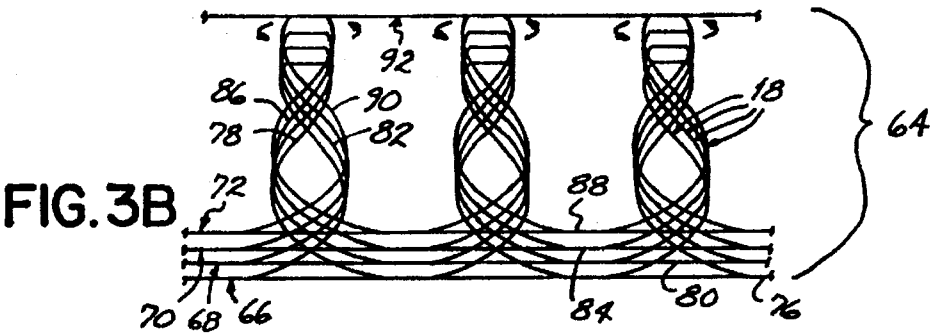
Figure 3C:
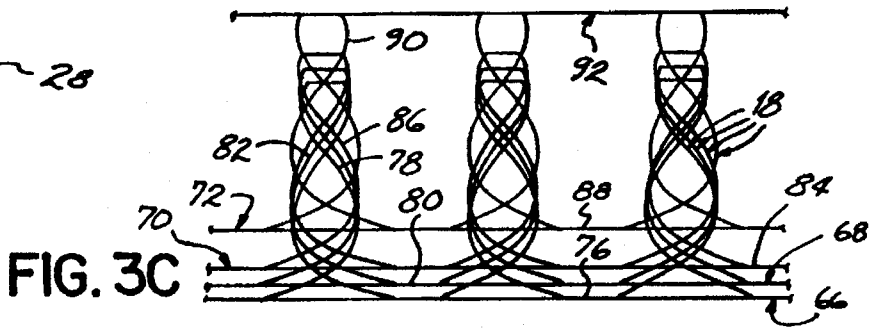
Figure 2:
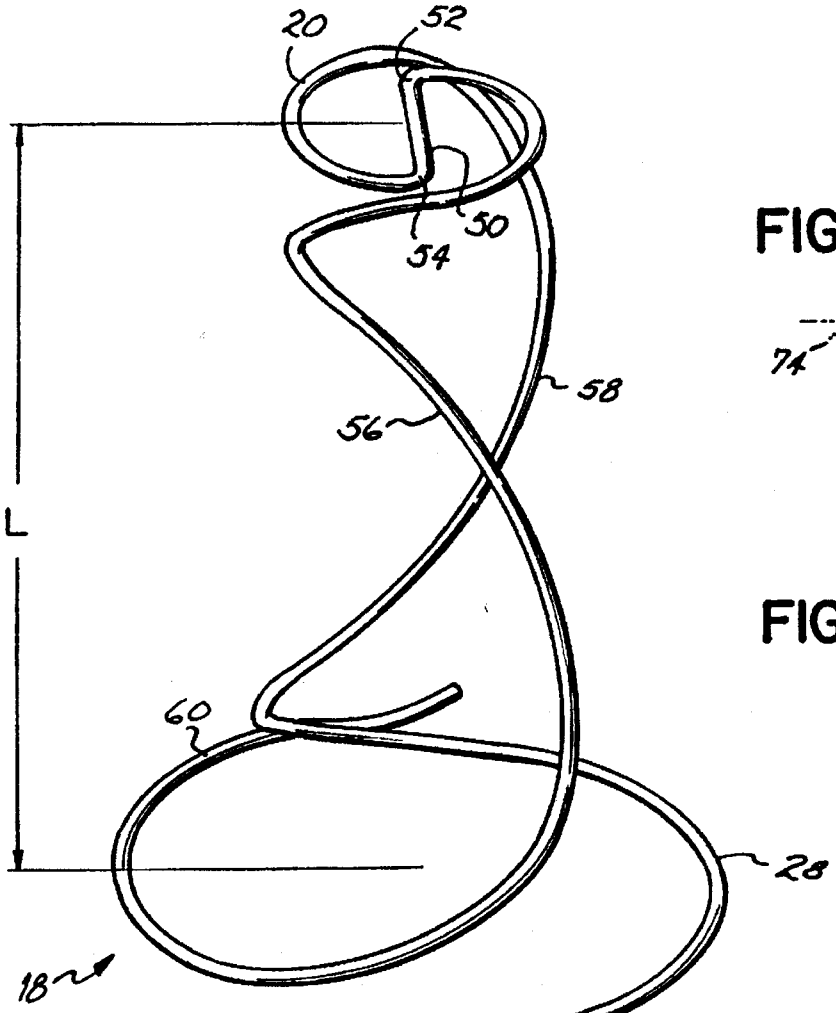
FIG. 2 is a perspective view of a single double twist coil spring utilized in the fully-assembled inner spring core of FIG. 1.

Referring to FIG. 2, each of the generally conical nestable spring elements 18 of a nestably stackable first spring unit 12 is made of a single piece of wire. Each spring element 18 has a cross bar 50 in the plane of the planar distal end portion 20. The cross bar 50 has two opposite ends 52 and 54. From the ends 52 and 54 of the cross bar 50 extend downwardly a first and second vertical spring arm 56 and 58, respectively. The first and second spring arms 56 and 58 are coiled downwardly from the ends 52 and 54, respectively, of the cross bar 50 in the same rotational direction and are formed into a helix of increasing pitch extending over a major portion of the axial length L of each spring element 18. The first and second spring arms 56 and 58 terminate in first and second free ends 60 and 62 respectively, both located in the plane of the bottom planar portion 28 of the spring element 18. The first and second free ends 60 and 62 are diametrically opposed to one another and relatively flexible, enabling easy attachment of either free end to the border wire 22 of a nestably stackable first spring unit 12 or to the diametrically opposite free end of an adjacent spring element. The design of the double twist spring elements enables large manufacturing tolerances and lowers the cost of manufacturing as described in U.S. Pat. No. 4,639,957 issued to the assignee of the present invention, FIGS. 3A–3C illustrate a method of assembling the inner spring core 10 of the present invention. FIG. 3A illustrates a stack 64 of four nestably stackable first spring units 66, 68, 70, 72, one stacked on top of the other, the stack resting on a horizontal surface 74. The stack 64 is placed on the horizontal surface 74 such that the lowermost nestably stackable first spring unit 66 rests on the horizontal surface 74 with its spring elements 78 extending upwardly.

To form the stack 64, a lowermost nestably stackable first spring unit 66 is placed on horizontal surface 74 such that its generally planar platform 76 rests on the horizontal surface 74 and its generally conical nestable spring elements 78 extend upwardly. A second identically configured nestably stackable first spring unit 68 is placed upon the lowermost nestably stackable first spring unit 66 so that the spring elements 78 of nestably stackable first spring unit 66 nest inside the spring elements 82 of nestably stackable first spring unit 68. Such nesting of the spring elements causes the generally planar platform 80 of the nestably stackable first spring unit 68 to rest a distance $d_1$ above the generally planar platform 76 of the lowermost nestably stackable first spring unit 66.

In like fashion nestably stackable first spring unit 70 is placed upon nestably stackable first spring unit 68 so that generally planar platform 84 rests a distance $d_2$ above the generally planar platform 80 of nestably stackable first spring unit 68. Spring elements 86 of nestably stackable first spring unit 70 sit on spring elements 82 of nestably stackable first spring unit 68.

Finally uppermost nestably stackable first spring unit 72 is placed on top of nestably stackable first spring unit 70 so that generally planar platform 88 rests a distance $d_3$ above the generally planar platform 84 of nestably stackable first spring unit 70. Distances $d_3$, $d_2$ and $d_1$ are all identical. Spring elements 90 of nestably stackable first unit 72 sit atop spring elements 86 of nestably stackable first spring unit 70.

As illustrated in FIG. 3A, to assemble an inner spring core a second stackable grid unit 92 is lowered downwardly toward the stack 64 of nestably stackable first spring units 12.

FIG. 3B illustrates the same second stackable grid unit 92 of FIG. 3A being placed on the planar distal end portions 20 of the spring elements 90 of the uppermost nestably stackable first spring unit 72. In order to secure the uppermost nestably stackable first spring unit 72 to the second stackable grid unit 92 the planar distal end portions 20 of the spring elements 90 of the uppermost nestably stackable first spring unit 72 are placed directly under the snap-fit connectors 46 of the second stackable grid unit 92. Either the entire second stackable grid unit 92 may be rotated or the individual spring elements 90 of the uppermost nestably stackable first spring unit 72 may be rotated clockwise or counter-clockwise in order to secure the second stackable grid unit 92 to the planar distal end portions 20 of the uppermost spring elements 90.

As shown in FIG. 3C, the second stackable grid unit 92 is then lifted upward causing the uppermost nestably stackable first spring unit 72 to lift off the stack 64 of nestably stackable first spring units. The newly assembled inner spring core is then placed to the side for further processing. A fully assembled inner spring core is thereby assembled with a minimum of effort and cost.

Figure 4A:
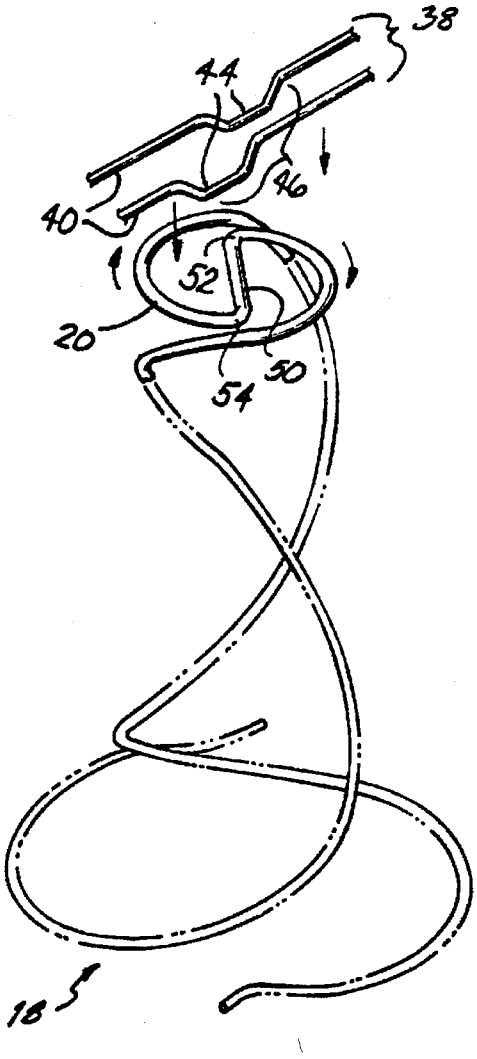

FIGS. 4A and B show in greater detail the locking engagement of the first and second stackable units, more specifically the attachment between a snap-fit connector 46 of a second stackable grid unit 14 and a planar distal end portion 20 of a spring element 18 of a nestably stackable first spring unit 12. The connector crimps 44 of a pair 38 of transverse wires 40 are offset relative to one another, forming a snap-fit connector 46. Upon engagement with the planar distal end portion 20 of a spring element 18, the spring element 18 will be lockingly engaged with the snap-fit connector 46 of the grid platform 34 of the second stackable grid unit 14.

Figure 4B:
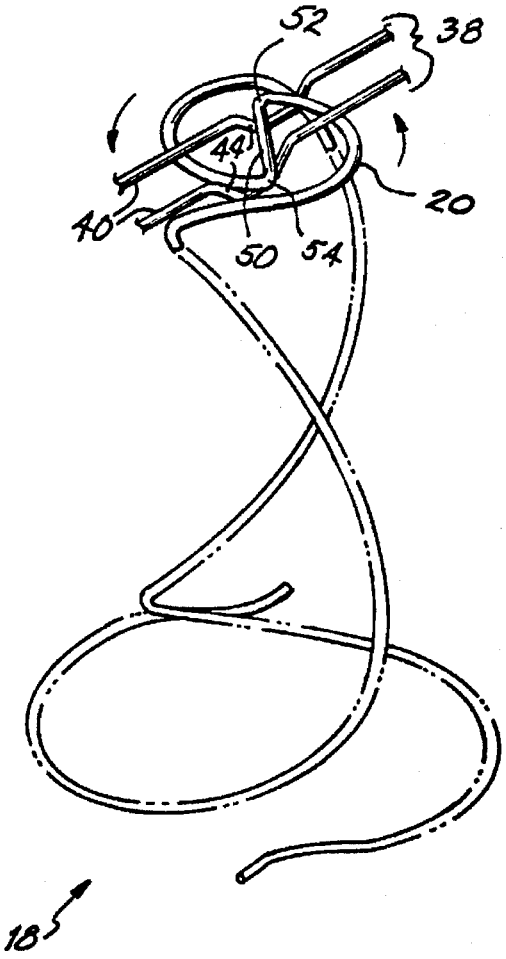
FIG. 4B is a perspective view of the spring element of FIG. 4A rotating into a locking engagement with the set of connectors on the transverse wires of the second stackable grid unit of FIG. 4A.

As seen in FIG. 4A the spring arms 56 and 58 of the spring element 18 may be rotated clockwise so that the cross-bar 50 of the spring element 18 fits in between the connector crimps 44 of snap-fit connector 46. Upon release of the spring arms 56 and 58 the inherent characteristics of the spring element 18 cause the planar distal end portion 20 of the spring element 18 to twist back to its original position with the cross-bar 50 of the planar distal end portion 20 of the spring element 18 at an oblique angle to the transverse wires 40 of the wire grid platform 34, causing the connector crimps 44 to be lockingly engaged with the planar distal end portion 20 of the spring element 18 as seen in FIG. 4B.

Figure 5:
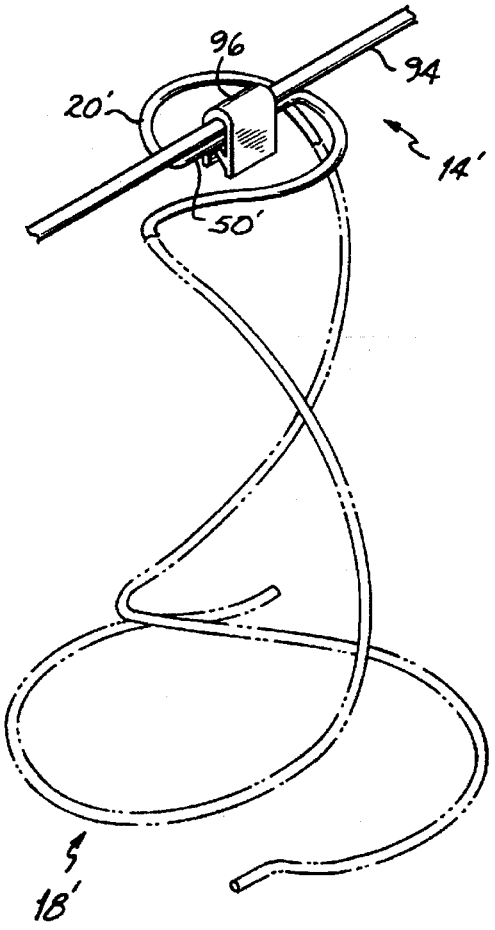
FIG. 5 is a perspective view of a second embodiment of the present invention showing a clip securing the second stackable grid unit to the distal end portion of a spring element of the nestably stackable first spring unit.
Figure 6:
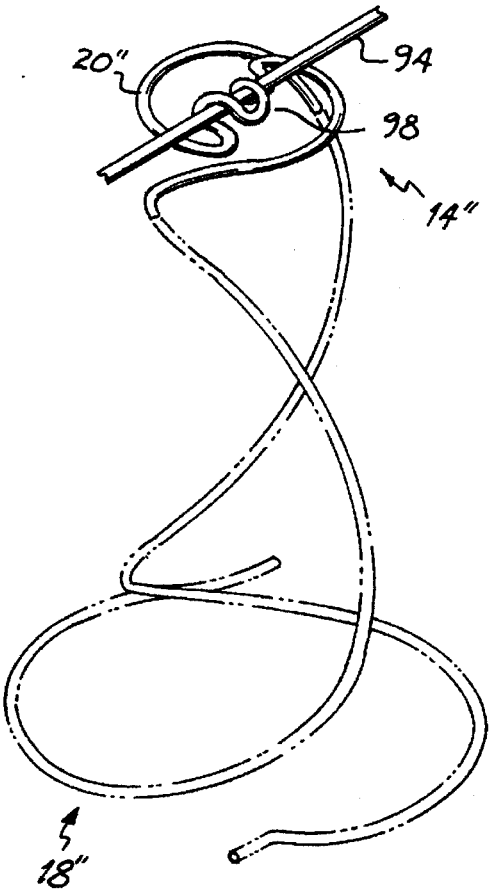
FIG. 6 is a perspective view of a third embodiment showing a generally U-shaped crimp formed in the distal end portion of a spring element for securing the second stackable grid unit to the nestably stackable first spring unit.

FIGS. 5 and 6 illustrate alternative embodiments of the present invention in which the wire grid platform 34 of the second stackable grid unit 14 has a plurality of straight transverse wires 94 orthogonal to longitudinal straight wires 36 unlike in the preferred embodiment in which a plurality of pairs 38 of transverse wires 40 are orthogonal to the longitudinal wires 36. Otherwise expressed, in these embodiments, a single transverse wire 94 replaces each pair 38 of transverse wires 40 of the first embodiment of FIGS. 1–4.

For the sake of convenience, identical parts or elements of the alternative embodiments which are identical to similar elements of the preferred embodiment have been denoted by the same numeral as used for that same element in the preferred embodiment followed by a prime or double prime mark.

In the second embodiment of the present invention illustrated in FIG. 5, the distal end portion 20' of each spring element 18' of a first stackable nestable first spring unit is identical to the distal end portion 20 of each spring element 18 of the preferred embodiment. In this second embodiment the spring element 18' is oriented so that the cross bar 50' of the planar distal end portion 20' of the spring element 18' is parallel to and underneath the transverse wire 94 as illustrated in FIG. 5. A formed plastic clip 96 or other suitable fastener attaches the cross bar 50' of the spring element 18' to the transverse wire 94. Clips 96 may be attached manually or by a machine.

FIG. 6 illustrates a third embodiment of the present invention in which the distal end portion 20" of the spring element 18" is not planar as in the other two embodiments but rather has a raised generally U-shaped crimp 98 formed above the rest of the generally planar distal end portion 20" of the spring element 18". After insertion of a transverse wire 94 into the U-shaped section of the distal end portion 20" of a spring element 18", the crimp 98 is bent over the transverse wire 94 in order to secure the nestably stackable first spring unit 12" to the second stackable grid unit 14". The bending of the crimp 98 over the transverse wire 94 of the second stackable unit 14" may be done manually or by a machine. Other than the distal end portion 20" of the spring element 18", the spring element 18" in this third embodiment is identical to spring element 18 of the preferred embodiment.

From the foregoing it will be appreciated that many spring assemblies may be able to fit into a smaller packing area, thus reducing the cost of shipping. With both the first and second units of the present invention being stackable and the spring elements of the first unit also being nestable, many first and second units may fit compactly into a small area. Assembly of a complete inner spring core assembly from one nestably stackable first spring unit and one second stackable grid unit lockingly engaged to each other may be accomplished without any extensive tooling or machine parts. Assembly may be accomplished by hand or by machine, lowering the cost of assembly.

While I have described only three preferred embodiments of our invention, I do not intend to be limited except by the scope of the following claims. For example, it will be readily apparent to those skilled in the art that 'differing' configurations of nestably stackable coil springs or modular springs as well as different configurations of the connectors which attach the distal end portions of the springs to the second stackable grid unit may be used in the practice of this invention.

What is claimed is:

1. A mattress comprising:

an inner spring core having a nestably stackable first spring unit comprising a first generally planar platform in a first plane and a plurality of generally conical nestable spring elements extending in one direction from said first platform, each of said spring elements having a circumference which lessens as said spring element extends in said one direction, said spring element terminating in a distal end portion, a second stackable grid unit in a second plane, said second stackable grid unit comprising a rectangular border wire fixedly attached to a plurality of pairs of transverse wires and longitudinal wires, said longitudinal wires being perpendicular to said transverse wires, said wires being connected at their points of intersection, said transverse wires having connectors formed therein, said connectors lockingly engaging said distal end portions of said spring elements to said second stackable grid unit in said second plane;

a mattress pad; and an upholstered fabric covering encasing said inner spring core and mattress pad.

2. An inner spring core comprising:

a nestably stackable first spring unit comprising a first generally planar platform in a first plane and a plurality of generally conical nestable spring elements extending in one direction from said first platform, each of said spring elements having a circumference which lessens as said spring element extends in said one direction, each of said spring elements terminating in a distal end portion;

a second stackable grid unit in a second plane, said second stackable grid unit comprising a rectangular border wire fixedly attached to a plurality of pairs of transverse wires and longitudinal wires, said longitudinal wires being perpendicular to said transverse wires, said transverse wires having connectors formed therein, said connectors lockingly engaging said distal end portions of said spring elements in said second plane.

3. The inner spring core of claim 2 wherein each said distal end portion is substantially planar.

4. The inner spring core of claim 2 wherein each of said connectors comprises a pair of side-by-side parallel wires, each of said side-by-side parallel wires having at least one crimp, each crimp being adapted to receive the distal end portion of a spring element.

5. The inner spring core of claim 2 wherein said first generally planer platform comprises a generally rectangular border wire surrounding a bottom planar portion of each of said spring elements, said bottom planar portions of said spring elements being arranged in rows and columns, said border wire being fixedly attached to the bottom planar portion of the outermost spring elements and a plurality of parallel helical lacing wires connecting adjacent rows of said bottom planar portions of adjacent spring elements.

6. The inner spring core of claim 5 wherein each of said parallel helical lacing wires extends from a point just inside one side of said rectangular border wire to a point just inside an opposite side of said rectangular border wire.

7. The inner spring core of claim 2 wherein each of said generally conical nestable spring elements is of a single length of wire having a cross bar, said cross bar having two opposite ends from which extend a first and second vertical spring arm, each of said first and second vertical spring arms being coiled from one end of said cross bar in the same rotational direction and formed into a helix of increasing pitch extending over a major portion of the axial length of said spring element; said first and second vertical spring arms terminating in diametrically opposed first and second free ends, said first and second free ends being located in the plane of said first generally planar platform.

8. The inner spring core of claim 2 wherein said transverse wires have multiple spaced crimps with the crimps on each of said pair of transverse wires being offset laterally so as to facilitate reception of the distal end portion of a spring element.

9. A mattress inner spring core comprising:

a nestable stackable first spring unit comprising a plurality of spring elements arranged in rows and columns, each spring element having a bottom portion generally lying in a first plane, a middle portion extending from said bottom portion in one direction to a distal end portion, said middle portion lessening in circumference as said middle portion extends in said one direction, the distal end portions of said plurality of spring elements lying substantially in a second plane spaced from and parallel to said first plane, said bottom portions of adjacent spring elements being joined together by helical lacing wire and said bottom portions of the outermost spring elements being secured to a rectangular border wire lying in said first plane;

a second stackable grid unit lying generally in said second plane including a rectangular border wire fixedly attached to a plurality of straight longitudinal wires and to a plurality of pairs of transverse wires, said longitudinal wires being perpendicular to said transverse wires, said wires being connected at their points of intersection, and each of said pairs of transverse wires having a series of connectors formed therein.

10. The mattress innerspring core of claim 9 wherein said connectors have crimps on one wire of each pair of said transverse wires offset relative to the crimps of the other wire of said pair.

11. An inner spring core comprising:

a nestably stackable first spring unit including a generally planar platform in a first plane and a plurality of nestable conical spiral spring elements, each of said spring elements extending from said platform to a distal end portion and having a circumference which lessens as said spring element extends away from said platform, each of said distal end portions being located in a second plane, whereby a plurality of said first spring units may be nestably stacked together, one on top of another, with the spring elements of one of said first spring units being nested into the spring elements of another first spring unit thereabove;

a second stackable grid unit comprising a rectangular border wire secured to the ends of a plurality of pairs of transverse wires and longitudinal wires, said longitudinal wires being substantially perpendicular to said transverse wires and connected at their points of intersection. said transverse wires having therein a plurality of connectors, said connectors lockingly engaging said distal end portions of said spring elements of the uppermost nestable stackable first spring unit to said second stackable grid unit in said second plane.

12. A method of assembling an inner spring core which core comprises a nestably stackable first spring unit having a first generally planar platform and a plurality of generally conical nestable stackable spring elements extending in one direction from said first platform, each of said spring elements terminating in a planar distal end portion, and a second stackable grid unit comprising a second generally planar platform having a plurality of connectors in the plane of said second planar platform, which method comprises the steps of:

a. forming a stack of nestably stackable first spring units by placing a plurality of nestably stacked first spring units upon a horizontal supporting surface with the distal end portions of said spring elements extending upwardly from said first planar platforms;

b. placing one of said second stackable grid units above the topmost one of said nestably stacked first spring units;

c. lowering said one of said second grid units until said connectors rest on said planar distal end portions of said generally conical nestable spring elements of said topmost one of said nestably stackable first spring units; and d. twisting said one of said second stackable grid units relative to said topmost one of said nestably stacked first spring units to thereby lock said one of said second grid units to the topmost one of said nestably stacked first spring units.

13. The method of claim 2 which further comprises the steps of lifting up said one of said second stackable grid units after the locking of said one of said second grid units to said topmost one of said nestably stacked first spring units to thereby withdraw said topmost one of said first spring units from the stack of first spring units.

14. A method of assembling an inner spring core which core comprises a nestably stackable first spring unit having a first generally planar platform and a plurality of generally conical nestable stackable spring elements extending in one direction from said first platform, each of said spring elements terminating in a planar distal end portion, and a second stackable grid unit comprising a second generally planar platform having a plurality of connectors in the plane of said second planar platform which method comprises the steps of:

a. placing one of said nestably stackable first spring units upon a horizontal surface with the distal end portions of said spring elements extending upwardly from said first planar platform;

b. stacking multiple nestably stackable first spring units one upon the other in an identical orientation such that the spring elements of one of said nestably stackable first spring units nest into the spring elements of another nestably stackable first spring unit thereabove;

c. placing one of said second stackable grid units on top of the topmost of said nestably stackable first spring units such that said planar distal end portions of said spring elements are directly beneath said connectors of said one of said second stackable grid units;

d. maneuvering said one of said second stackable grid units, so as to lockingiy engage said planar distal end portions of said spring elements with said connectors of said one of said second stackable grid units; and e. lifting up on said one of said second stackable grid units causing the top nestably stackable first spring unit to lift away from the remainder of the stack of said first spring units with said one of said second stackable grid units locked thereto to form one assembled inner spring core.

15. A method of assembling an inner spring core which core comprises a nestably stackable first spring unit having a first generally planar platform and a plurality of generally conical nestable stackable spring elements extending in one direction from said first platform, each of said spring elements terminating in a planar distal end portion, and a second stackable grid unit comprising a second generally planar platform having a plurality of connectors in the plane of said second planar platform, which method comprises the steps of:

a. forming a stack of nestably stackable first spring units by placing a plurality of nestably stacked first spring units upon a horizontal supporting surface with the distal end portions of said spring elements extending upwardly from said first planar platforms;

b. lowering one of said second stackable grid units until said connectors of said one of said second stackable grid units are proximate said planar distal end portions of said generally conical nestable spring elements of the topmost one of said nestably stackable first spring units; and c. maneuvering said one of said second stackable grid units so as to lockingly engage said planar distal end portions of said spring elements of said topmost one of said nestably stacked first spring units with said connectors of said one of said second stackable grid units.

16. The method of claim 15 which further comprises the step of lifting up said one of said second stackable grid units after the locking of said one of said second grid units to said topmost one of said nestably stacked first spring units to thereby withdraw said topmost one of said first spring units from the stack of first spring units.

17. A method of assembling an inner spring core which core comprises a nestably stackable first spring unit having a first generally planar platform and a plurality of generally conical nestable stackable spring elements extending in one direction from said first platform, each of said spring elements terminating in a planar distal end portion, and a second stackable grid unit comprising a second generally planar platform having a plurality of connectors in the plane of said second planar platform which method comprises the steps of:

a. placing said nestably stackable first spring unit upon a horizontal surface with said distal end portions of said spring elements extending upwardly from said first planar platform;

b. rotating said second stackable grid unit relative to said planar distal end portions of said spring elements of said first spring unit so as to cause locking engagement of said distal end portions of said spring elements of said first spring unit with said connectors of said second stackable grid unit to form one assembled inner spring core.

18. An inner spring core comprising:

a nestably stackable first spring unit comprising a first generally planar platform in a first plane and a plurality of generally conical nestable spring elements extending in one direction from said first platform, each of said spring elements having a circumference which lessens as said spring element extends in said one direction, each of said spring elements terminating in a distal end portion;

a second stackable grid unit in a second plane, said second stackable grid unit comprising a rectangular border wire fixedly secured to the ends of a plurality of transverse wires and longitudinal wires, said longitudinal wires being substantially perpendicular to said transverse wires and fixedly connected at their points of intersection; and multiple connectors located substantially in said second plane, said connectors lockingly engaging said distal end portions of said spring elements to said wires of said second stackable grid unit in said second plane.

19. The inner spring core of claim 18 wherein each of said connectors comprises a clip.

20. The inner spring core of claim 18 wherein each of said connectors comprises a crimp in said distal end portions of said spring elements.

* * * * *